US006549180B1

(12) United States Patent
Yoo et al.

(10) Patent No.: US 6,549,180 B1
(45) Date of Patent: Apr. 15, 2003

(54) PLASMA DISPLAY PANEL AND DRIVING METHOD THEREOF

(75) Inventors: Eun Ho Yoo, Kyunggi-do (KR); Woo Gon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/303,557

(22) Filed: May 3, 1999

(30) Foreign Application Priority Data

May 4, 1998 (KR) ..... 98-16012

(51) Int. Cl.[7] ..... G09G 3/28

(52) U.S. Cl. ..... 345/60; 345/55; 345/61; 345/62; 345/67; 345/56; 345/72; 315/169.4; 315/169.3; 313/586; 313/582; 313/587

(58) Field of Search ..... 345/55, 60, 61, 345/62, 67, 56; 315/169.3, 169.4; 313/582, 586, 587

(56) References Cited

U.S. PATENT DOCUMENTS 3,969,651 A * 7/1976 Greeson, Jr. ..... 315/169
3,990,068 A * 11/1976 Mayer et al. ..... 340/324
4,044,349 A * 8/1977 Andoh et al. ..... 340/324
4,045,790 A * 8/1977 Miller ..... 340/324
5,446,344 A 8/1995 Kanazawa
5,874,932 A * 2/1999 Nagaoka et al. ..... 345/60
6,002,381 A * 12/1999 Tomio et al. ..... 345/60
6,144,349 A * 11/2000 Awata et al. ..... 345/67
6,157,355 A * 12/2000 Ide ..... 345/60
6,181,305 B1 * 1/2001 Nguyen et al. ..... 345/60
6,188,374 B1 * 2/2001 Moon ..... 345/60
6,295,040 B1 * 9/2001 Nhan et al. ..... 345/60

FOREIGN PATENT DOCUMENTS

JP 7-064508 3/1995

* cited by examiner

*Primary Examiner*—Richard Hjerpe
*Assistant Examiner*—Ali Zamani
(74) *Attorney, Agent, or Firm*—Fleshner & Kim, LLP

(57) ABSTRACT

A plasma display panel that is adaptive for shortening an address interval. The PDP is provided with first and second sustaining electrode lines making each row line, and first and second address electrode lines making each column line. The first and second address electrode lines are alternately overlapped with an insulating material as the row lines are progressed.

18 Claims, 7 Drawing Sheets

PLASMA DISPLAY PANEL AND DRIVING METHOD THEREOF

BACKGROUND OF THE INVENTION

1. Field of the Invention

This invention relates to a plasma display panel used for a flat display device, and more particularly to a plasma display panel that is adapted to shorten an addressing time and a driving method thereof.

2. Description of the Related Art

The conventional alternating current plasma display panel has cells arranged in a matrix pattern. As shown in FIGS. 1A and 1B, the cells of the plasma display panel(PDP) includes an upper glass substrate 10 and a lower glass substrate 12 which are spaced, in parallel, with a barrier rib 14. The barrier rib 14 provides a discharge space isolated between the upper glass substrate 10 and the lower glass substrate 12. On the bottom surface of the upper glass substrate 10 is installed a sustaining electrode pair 16 which consists of a scanning/sustaining electrode 16A, hereinafter referred to as "Y sustaining electrode", and a sustaining electrode 16B, hereinafter referred to as "Z sustaining-electrode". An upper dielectric layer 18 and a protective film 20 is sequentially formed on the bottom surface of the upper glass substrate 10 under which the sustaining electrode pair 16 is installed. The upper dielectric layer 18 accumulates electric charges, and the protective film 20 protects the upper dielectric layer 18 from a sputtering of plasma particles. The protective film 20 permits a life of the upper dielectric layer 18 to be prolonged, an emission efficiency of secondary electrons to be enhanced, and a change in a discharge characteristic due to an oxide contamination of a refractory metal to be restrained. To this end, the protective film 20 is mainly made from MgO. Meanwhile, the lower glass substrate 12 has an address electrode 22 provided on the surface thereof. On the lower glass substrate 12 provided with the address electrode 22 is coated a lower dielectric layer 24 for accumulating electric charges and a fluorescent layer 26 for emitting visible rays with intrinsic colors. The fluorescent layer 26 is coated on the lower glass substrate 12 in such a manner to be extended into a wall surface of the barrier rib 14. The fluorescent layer 26 is excited and transited by an ultraviolet with a short wavelength generated during the gas discharge to thereby emit red(R), green(G), and blue(B) visible lights. A mixture gas of Ne and Xe is filled in the discharge space provided by the barrier rib 14 so as to enhance the generation efficiency of an ultraviolet.

As shown in FIG. 2, an alternating current PDP having the cells with the structure as described above includes electrode lines arranged in a matrix pattern. In the alternating current (AC) PDP of FIG. 2, the Y sustaining electrode lines 16A and the Z sustaining electrode lines 16B is alternately arranged in the vertical direction. The Y and Z sustaining electrodes 16A and 16B are crossed with address electrode lines 22 arranged, in parallel, in the horizontal direction. For instance, to construct the conventional VGA-class color PDP with 640×480 pixels requires 480 Y and Z sustaining electrode line pairs(i.e., Y1 to Y480 and Z1 to Z480) and 1920 address electrode lines (i.e., X1 to X1920). To require 1920 in the number of address electrode lines is caused by a fact that a single pixel consists of red, green and blue color pixel. Each of the Y and Z sustaining electrode line pairs 16A and 16B making row lines allows the cells to be scanned in the line unit and, at the same time, the discharge to be kept continuously. The address electrode lines 22 making column lines are used to write a data into each cell of the PDP.

The AC PDP with such an electrode structure is driven in a sub-field system as shown in FIG. 3 so as to display a gray level of color picture. As shown in FIG. 3, a PDP driving method of sub-field system divides a frame interval for displaying a single picture into a plurality of sub-fields, for example, 8 sub-fields SF1 to SF8. Each of the plurality of sub-fields has a radiation interval increasing gradually in such a manner to have a brightness value of $2^0, 2^1, 2^2, \cdots 2^{X-2}, 2^{X-1}$. The gray level of a color picture is implemented by a combination of such sub-fields. For instance, when a single frame interval is divided into 8 sub-fields as shown in FIG. 3, the gray level from 0 to 256 is implemented. Each sub-field is divided into an address interval for selecting cells causing the discharge in the cells of the PDP and a sustaining interval for causing the radiation at each cell of the PDP. The address interval has a constant time width independently of the sub-fields while the sustaining interval has a different time width depending on the sub-fields. A wall charge is formed at the side of Y sustaining electrode in the address interval at each cell of the PDP to be discharged in the sustaining interval. In order to form a wall charge selectively at the cells of the PDP in this manner, the sustaining electrode lines Y1 to Y480 must sequentially be selected and, at the same time, the address electrodes X1 to X1920 is supplied with a data each time the sustaining electrode lines Y1 to Y480 are selected. More specifically, if a low voltage of scanning pulse is applied to the first sustaining electrode line Y1 and, simultaneously, a data pulse is applied to the address electrode lines X1 to X1920, then a discharge is selectively generated from cells positioned at an intersection of the first Y sustaining electrode line Y1 and the address electrode lines X1 to X1920. At this time, a discharge is generated only from the cells connected to the address electrode lines X applied with a high level of data pulse in the address electrode lines X1 to X1920 and, simultaneously, a wall charge is formed at the side of first Y sustaining electrode Y1 only at the cells as mentioned above. In the similar manner, a discharge is selectively generated by applying a low voltage of sustaining pulse to the second Y sustaining electrode line Y2 to the last Y sustaining electrode Y480 sequentially and, at the same time, applying a data pulse to the address electrode lines X1 to X1920 repeatedly. When such an address operation has been completed, a sustaining discharge is generated only from the cells formed with a wall charge by applying a sustaining voltage to each of the Y and Z sustaining electrode lines Y1 to Y480 and Z1 to Z480 simultaneously.

As described above, the conventional PDP driving method must sequentially select the Y sustaining electrode lines Y1 to Y480 every sub-field so as to select cells to be discharged. Due to this, the conventional PDP driving method can not help avoiding a long address interval. Also, the quantity of wall charges formed at the cells provided on the first row line in the course of the address interval becomes smaller than that formed at the cells provided on the last row lines. Due to this wall charge difference, a sustaining discharge appears non-uniformly on the panel. Such a non-uniformity in the sustaining discharge becomes more and more serious as the PDP has a tendency to a high picture quality. In view of this, it is required to provide a scheme capable of reducing the address interval.

SUMMARY OF THE INVENTION

Accordingly, it is an object of the present invention to provide a PDP that is adapted to shorten an address interval.

Further object of the present invention is to provide a PDP driving method that is suitable for shortening an address interval.

In order to achieve these and other objects of the invention, a plasma display panel according to one aspect of the present invention includes first and second sustaining electrode lines making each row line; and first and second address electrode lines making each column line. The plasma display panel further includes insulating material patterns formed in such a manner to be alternately superposed on the first and second address electrode lines as the row lines are progressed.

In a method of driving a plasma display panel according to another aspect of the present invention, an address discharge is simultaneously generated at two row lines by a data pulse applied to the first and second address electrode lines simultaneously and a voltage pulse synchronized with the data pulse to be applied to any one of the first and second sustaining electrode lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1A:
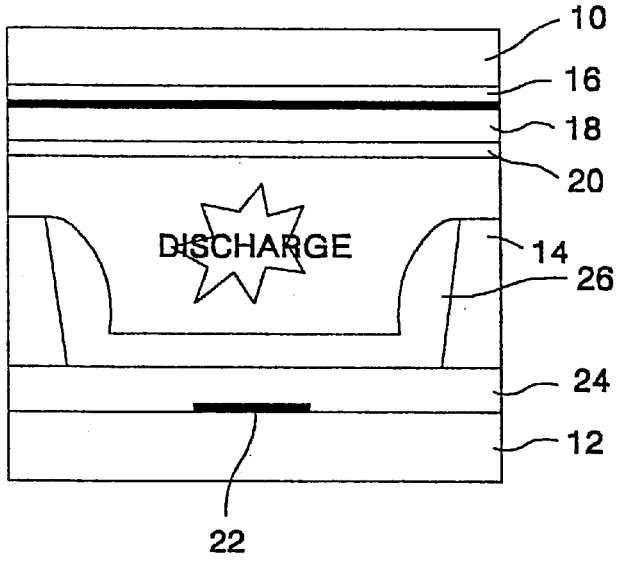
FIG.1A RELATED ART
FIGS. 1A and 1B are sectional views showing the cell structure of the conventional AC-system PDP.
Figure 1B:
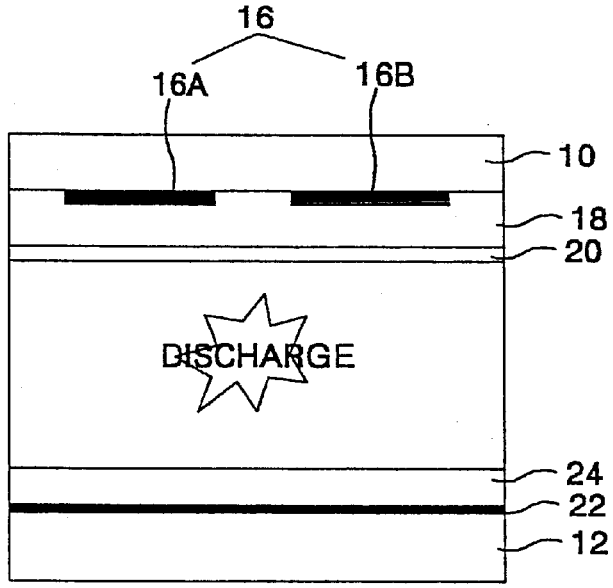
FIG.1B RELATED ART
Figure 2:
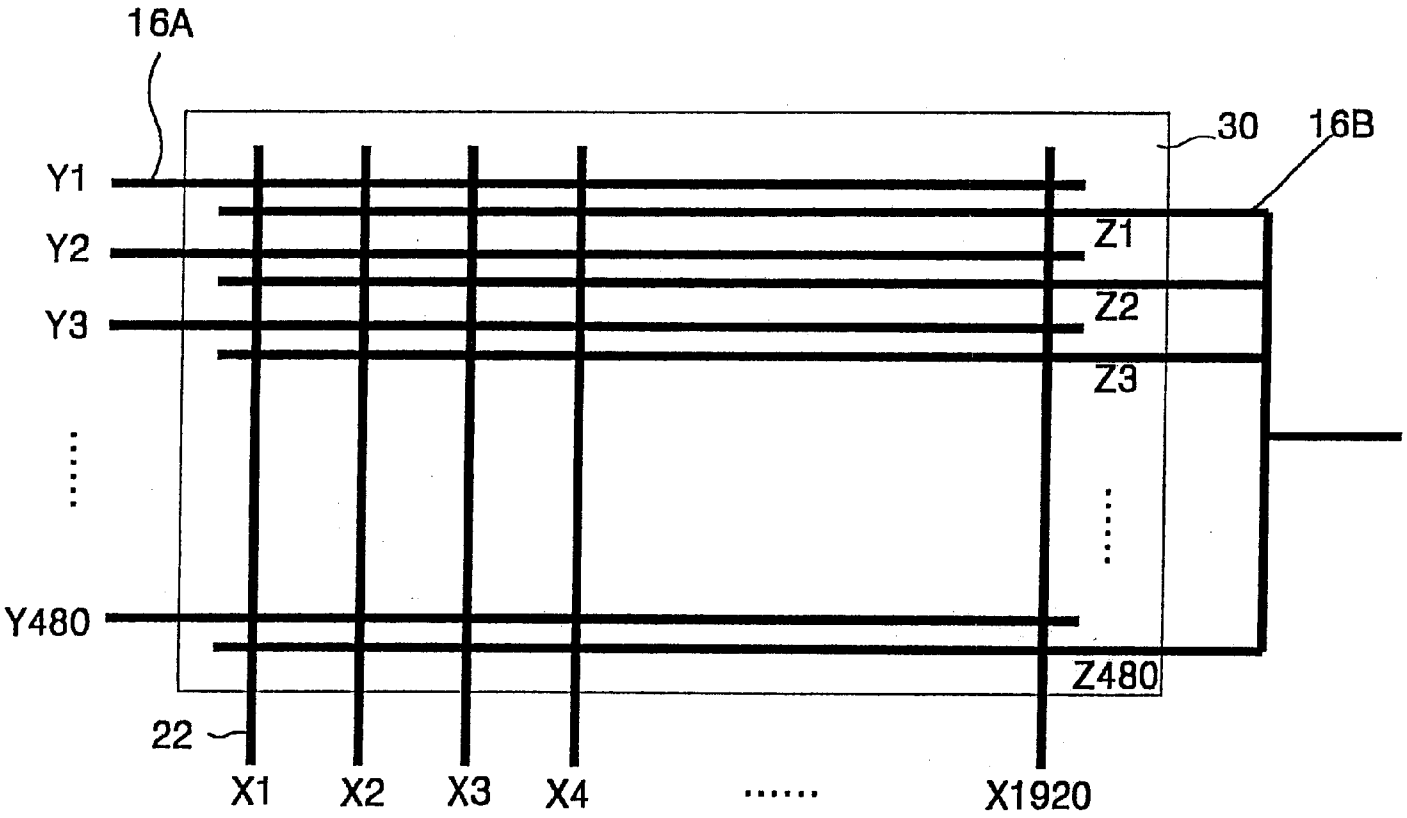
FIG. 2 RELATED ART
FIG. 2 is a schematic view showing the electrode structure of the convention PDP.
Figure 3:
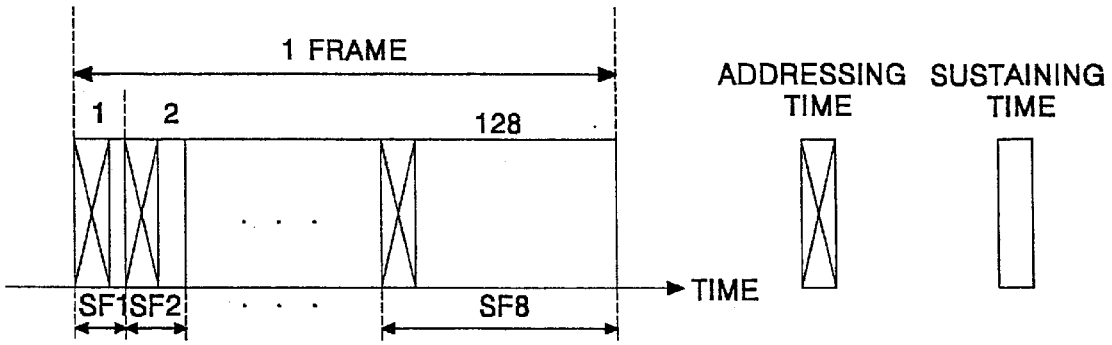
FIG.3 RELATED ART
FIG. 3 is a view for explaining the conventional PDP driving method.
Figure 4:
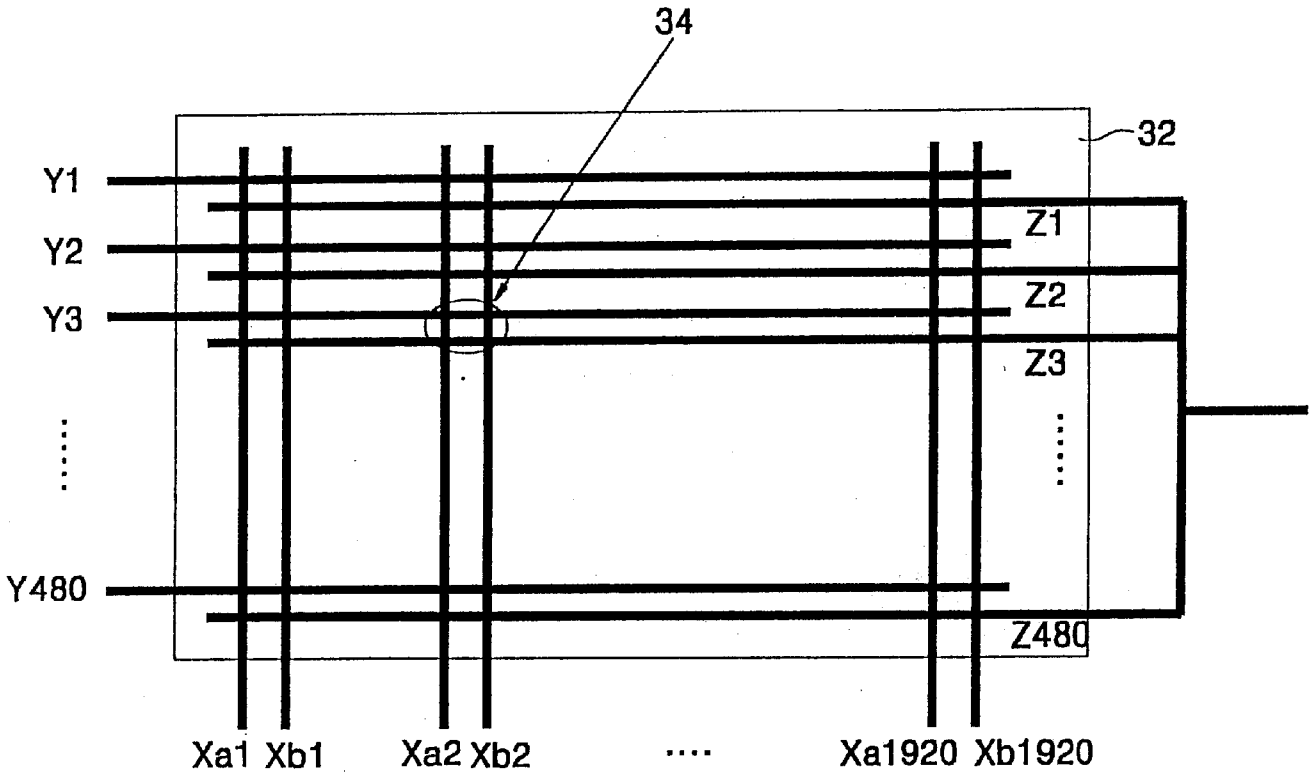
FIG. 4 is a schematic view showing the electrode structure of a PDP electrode according to an embodiment of the present invention.

Referring to FIG. 4, there is shown the electrode structure of a PDP according to an embodiment of the present invention. The PDP 32 includes Y and Z sustaining electrode line pairs Y1 to Y480 and Z1 to Z480 arranged, in parallel, in the vertical direction, and address electrode line pairs Xa1 to Xa1920 and Xb1 to Xb1920 arranged in the horizontal direction. A single cell 34 is formed at each intersecting position of the sustaining electrode line pairs Y1 to Y480 and Z1 to Z480 with the address electrode lines Xa1 to Xa1920 and Xb1 to Xb1920. In the case of forming a color PDP with 640×480 pixel number, generally, 480 Y and Z sustaining electrode line pairs Y1 to Y480 and Z1 to Z480 and 1920 address electrode line pairs Xa1 to Xa1920 and Xb1 to Xb1920 are required. The necessity of the 1920 address electrode line pairs Xa1 to Xa1920 and Xb1 to Xb1920 is caused by a fact that a single pixel consists of R, G and B pixels. The Y and Z sustaining electrode line pairs Y1 to Y480 and Z1 to Z480 making row lines allows pixels to be scanned in the line unit and, at the same time, a discharge generated from the pixels in the line unit to be maintained. The address electrode line pairs Xa1 to Xa1920 and Xb1 to Xb1920 making column lines is mainly used for the data input.

Figure 5:
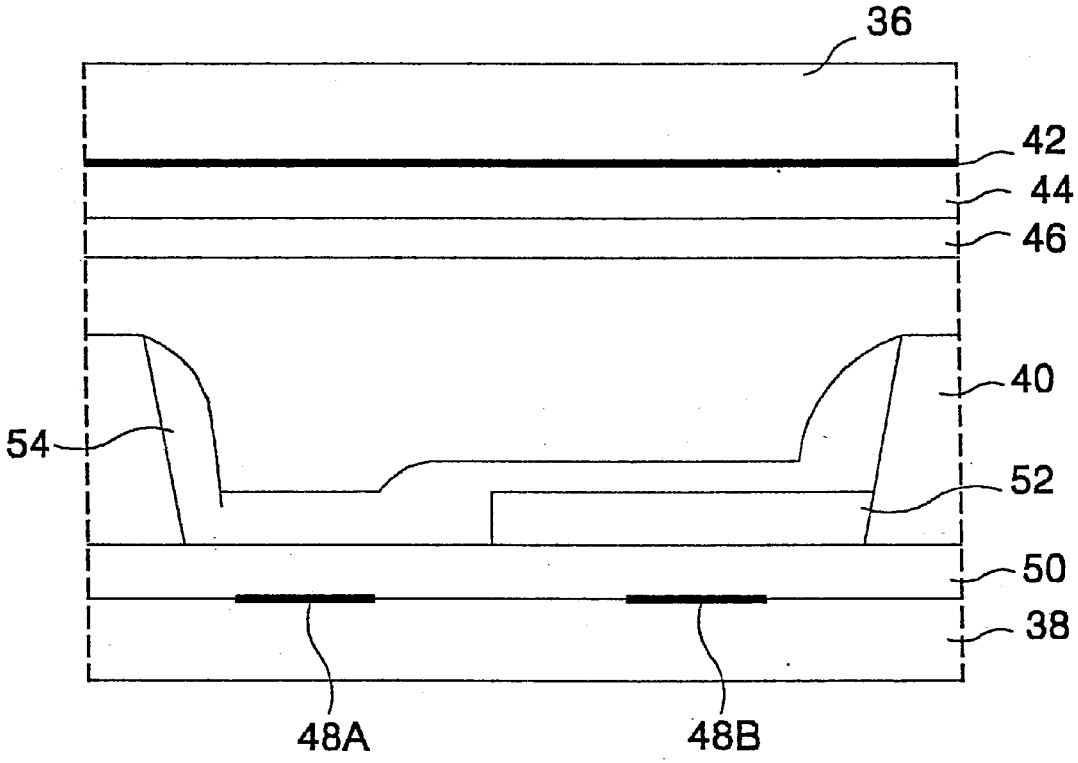
FIG. 5 is a sectional view showing the cell structure of a PDP electrode according to an embodiment of the present invention.

Referring now to FIG. 5, there is shown the structure of a cell included in a PDP according to an embodiment of the present invention. The cell of the PDP includes an upper glass substrate 36 and a lower glass substrate 38 which are spaced, in parallel, with a barrier rib 40. The barrier rib 40 provides a discharge space isolated between the upper glass substrate 36 and the lower glass substrate 38. On the bottom surface of the upper glass substrate 36 is installed a sustaining electrode pair 42 which consists of a Y sustaining electrode and a Z sustaining electrode. An upper dielectric layer 44 and a protective film 46 are sequentially formed on the bottom surface of the upper glass substrate 36 provided with the sustaining electrode pair 42. The upper dielectric layer 44 accumulates electric charges, and the protective film 46 protects the upper dielectric layer 44 from a sputtering of plasma particles. The protective film 46 permits a life of the upper dielectric layer 44 to be prolonged, an emission efficiency of secondary electrons to be enhanced, and a change in a discharge characteristic due to an oxide contamination of a refractory metal to be restrained. To this end, the protective film 46 is mainly made from MgO. Meanwhile, the lower glass substrate 38 has first and second address electrodes 48A and 48B installed, in parallel, on the surface thereof. On the lower glass substrate 38 provided with the first and second address electrodes 48A and 48B is evenly formed a lower dielectric layer 50 for accumulating electric charges. An insulating material pattern 52 is formed on the lower dielectric layer 50 in such a manner to be overlapped with the second address electrode 48B. The insulating material pattern 52 prevents a generation of discharge even when a data pulse is applied to the second address electrode 48B. Such an insulating material pattern 52 is formed on the lower dielectric layer 50 in such a manner to be overlapped with the first address electrode 48A instead of the second address electrode 48B along the sustaining electrode line 42. The barrier rib 40 and a fluorescent layer 54 for emitting visible rays with intrinsic colors are sequentially formed on the lower dielectric layer 50 provided with the insulating material pattern. The fluorescent layer 54 is coated on the lower glass substrate 50 in such a manner to be extended into a wall surface of the barrier rib 50. The fluorescent layer 54 is excited and transited by an ultraviolet with a short wavelength generated during the gas discharge to thereby emit red(R), green(G), and blue(B) visible lights. A mixture gas of Ne and Xe is filled in the discharge space provided by the barrier rib 40 so as to enhance the generation efficiency of an ultraviolet. Such a structure of PDP cell permits a wall charge to be formed on the upper and lower dielectric layers 44 and 50 when an address discharge is generated between the first address electrode 48A and any one of the sustaining electrode pair 42. Then, when a sustaining voltage is applied to the sustaining electrode pair 42, the PDP cell allows a sustaining discharge to be continuously generated, thereby producing a vacuum ultraviolet. At this time, a florescent body making the fluorescent layer 54 is excited and transited repeatedly by the vacuum ultraviolet to thereby emit visible rays.

Figure 6:
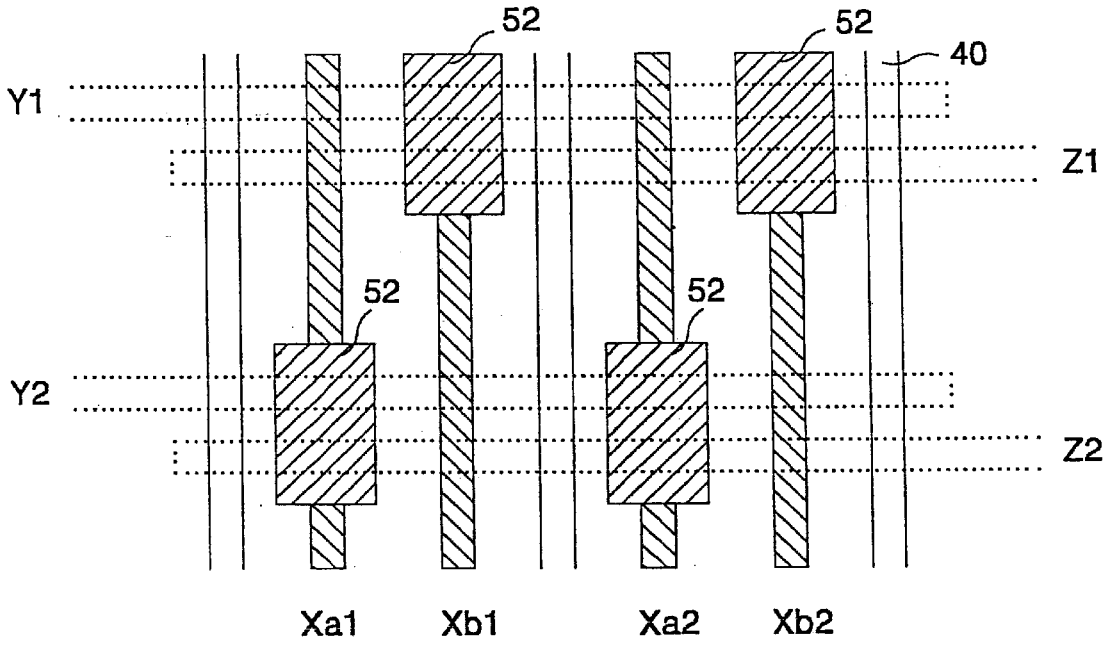
FIG. 6 is a detailed view showing the electrode structure of a PDP electrode with the cells in FIG. 5 according to an embodiment of the present invention.

Referring to FIG. 6, there is shown a layout of a PDP having the cells with the structure in FIG. 5 according to an embodiment of the present invention. In FIG. 6, each of the insulating material patterns 52 is overlapped with all the sustaining electrode pairs 40 and with any one of the first and second address electrodes 48A and 48B, more specifically, the insulating material patterns 52 overlapped with the odd-numbered sustaining electrode pair Y1 and Z1 are superposed on the second address electrode 48B while the insulating material patterns 52 overlapped with the even-numbered sustaining electrode pair Y2 and Z2 are superposed on the first address electrode 48A.

In the PDP according to the present invention having the structure as shown in FIG. 4 to FIG. 6, the cells is addressed for each two line. More specifically, during the address discharge, a low voltage of sustaining pulse is applied to the odd-numbered and even-numbered Y sustaining electrodes Y1 and Y2 and, at the same time, a data pulse is applied to the first and second address electrodes Xa1 to Xa1920 and Xb1 to Xb1920. At this time, a data pulse for selecting cells at the odd-numbered lines is applied to the first address electrodes Xa1 to Xa1920 while a data pulse for selecting cells at the even-numbered lines is applied to the second address electrodes Xb1 to Xb1920. In the cells at the odd-numbered lines, only an address discharge caused by the odd-numbered Y sustaining electrode Y1 and the first address electrode Xa is selectively generated, whereas an address discharge caused by the odd-numbered Y sustaining electrode Y1 and the second address electrode Xb is not generated. This results from the insulating material pattern 52 being overlapped with the second address electrode Xb. In the similar manner, in the cells at the even-numbered lines, only an address discharge caused by the even-numbered Y sustaining electrode Y2 and the second address electrode Xb is selectively generated, whereas an address discharge caused by the even-numbered Y sustaining electrode Y2 and the first address electrode Xa is not generated. This results from the insulating material pattern 52 being overlapped with the first address electrode Xa. In the PDP according to an embodiment of the present invention as described above, the cells are simultaneously addressed for each two line to shorten an addressing time into a half. In addition, a difference of a wall charge quantity accumulated on the cell at the last line from that accumulated on the cell at the first line can be reduced. Accordingly, the sustaining discharge appears uniformly on the panel.

Figure 7:
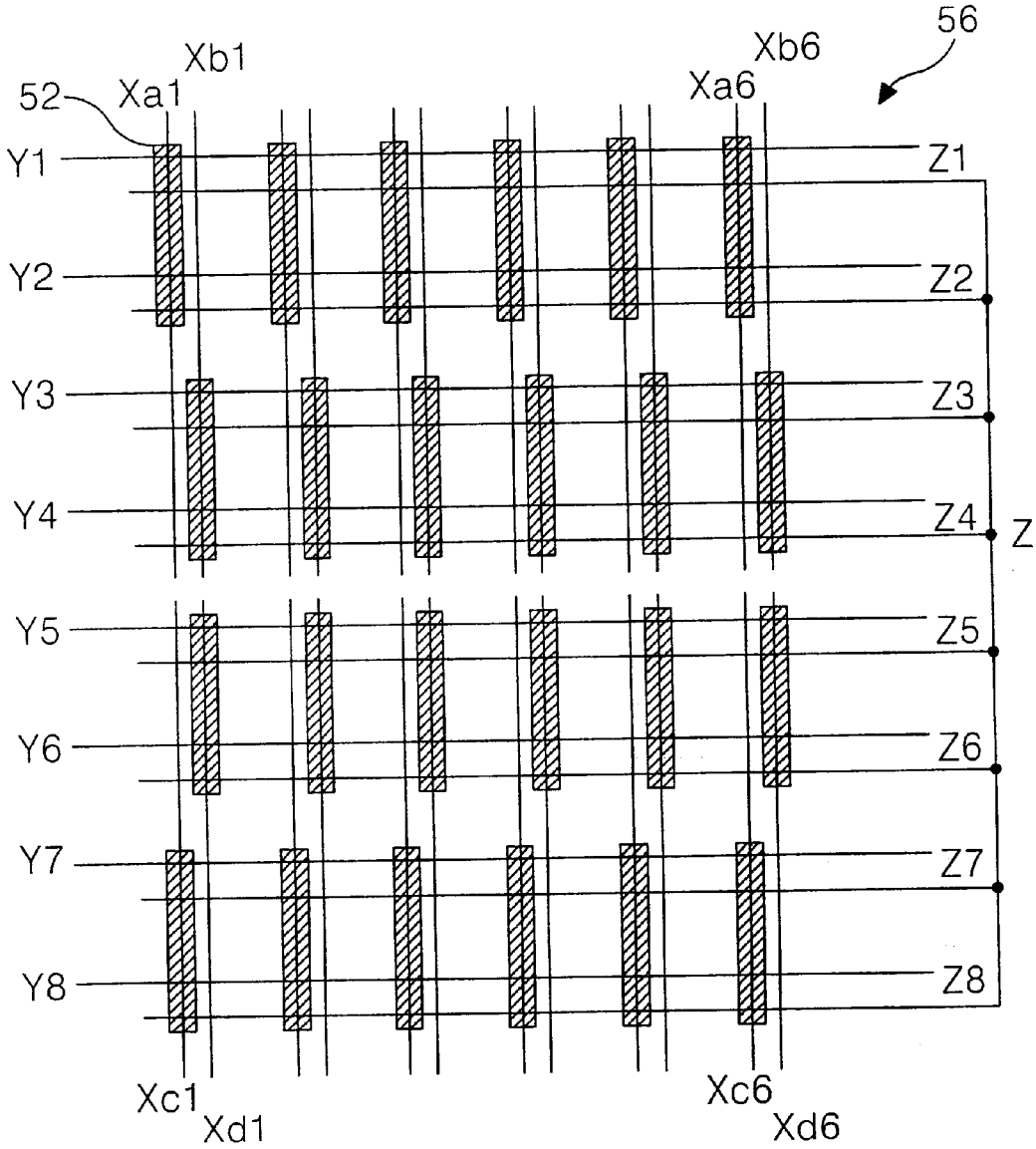
FIG. 7 is a schematic view showing the electrode structure of a PDP electrode according to another embodiment of the present invention.

Referring now to FIG. 7, there is shown an electrode structure of a PDP according to another embodiment of the present invention. The PDP 56 includes Y and Z sustaining electrode pairs Y1 to Y8 and Z1 to Z8 arranged, in parallel, in the vertical direction. Further, the PDP 56 includes first address electrodes Xa1 to Xa6 arranged, in parallel, in the horizontal direction at the upper half thereof, and third address electrodes Xc1 to Xc6 arranged, in parallel, in the horizontal direction at the lower half thereof. furthermore, the PDP 56 includes second address electrodes Xb1 to Xb6 arranged, in parallel, in the horizontal direction at the upper edge thereof, and fourth address electrodes Xd1 to Xd6 arranged, in parallel, in the horizontal direction at the lower edge thereof. The first address electrodes Xa1 to Xa6 are crossed with the first to fourth Y and Z sustaining electrode pairs Y1 to Y4 and Z1 to Z4 while the second address electrodes Xc1 to Xc6 are crossed with the fifth to eighth Y and Z sustaining pairs Y5 to Y8 and Z5 and Z8. The second address electrodes Xb1 to Xb6 are crossed with the first and second Y and Z sustaining electrode pairs Y1, Y2, Z1 and Z2 while the fourth address electrodes Xd1 to Xd6 are crossed with the seventh and eighth Y and Z sustaining electrode pairs Y7, Y8, Z7 and Z8. Each second address electrode Xb1 to Xb6 is installed in a single cell with making one set together with the first address electrodes Xa1 to Xa6 while each fourth address electrode Xd1 to Xd6 is installed in a single cell with making one set along with the third address electrodes Xc1 to Xc6. Also, an insulating material pattern 52 is superposed on each of the first and third address electrodes Xa1 to Xa6 and Xc1 to Xc6. The insulating material patterns 52 superposed on the first address electrodes Xa1 to Xa6 are formed in such a manner to be overlapped with the first and second sustaining electrodes Y1, Y2, Z1 and Z3, thereby allowing cells at the third and fourth Y and Z sustaining electrode pairs Y3, Y4, Z3 and Z4 to be addressed with the first address electrodes Xa1 to Xa6. The insulating material patterns 52 superposed on the third address electrodes Xc1 to Xc6 are formed in such a manner to be overlapped with the seventh and eighth Y and Z sustaining electrodes Y7, Y8, Z7 and Z8, thereby allowing cells at the fifth and sixth Y and Z sustaining electrode pairs Y5, Y6, Z5 and Z6 to be addressed with the third address electrodes Xc1 to Xc6.

In the PDP with the electrode structure as described above, the cells are addressed for each 4 line. More specifically, during the address discharge, a low voltage of sustaining pulse is applied to the odd-numbered Y sustaining electrodes Y1, Y3, Y5 and Y7 and, at the same time, a data pulse is applied to the first to fourth address electrodes Xa1 to Xa6, Xb1 to Xb6, Xc1 to Xc6 and Xd1 to Xd6. At this time, a data pulse for selecting the cells at the third line is applied to the first address electrodes Xa1 to Xa6; a data pulse for selecting the cells at the first line to the second address electrodes Xb1 to Xb6; a data pulse for selecting the cells at the fifth line to the third address electrodes Xc1 to Xc6; and a data pulse for selecting the cells at the seventh line to the fourth address electrodes Xd1 to Xd6. Only an address discharge caused by the first Y sustaining electrode Y1 and the second address electrode Xb is selectively generated from the cells at the first line while an address discharge caused by the first Y sustaining electrode Y1 and the first address electrode Xa is not generated. This results from the insulating material pattern 52 being superposed on the first address electrode Xa. In the similar manner, only an address discharge caused by the seventh Y sustaining electrode Y7 and the fourth address electrode Xd is selectively generated from the cells at the seventh line while an address discharge caused by the seventh Y sustaining electrode Y7 and the third address electrode Xc is not generated. This results from the insulating material pattern 52 being superposed on the third address electrode Xc. In addition, the cells at the third line selectively generate an address discharge, and the cells at the fifth line selectively generate an address discharge caused by the fifth Y sustaining electrode Y5 and the third address electrode Xc.

In the PDP according to another embodiment of the present invention as described above, the cells are simultaneously addressed for each 4 line to shorten an address time into ¼. In addition, a difference between a wall charge quantity accumulated to the cell at the first line and a wall charge quantity accumulated to the cell at the last line. Accordingly, a sustaining discharge appears uniformly on the panel.

As described above, in the PDP and the driving method thereof according to the present invention, two address electrode lines are arranged in parallel every column, thereby addressing two row lines simultaneously. Accordingly, the PDP and the driving method thereof according to the present invention is capable of shortening the address time into a half in comparison to the prior art. Also, the PDP and the driving method thereof according to the present invention allows the address electrode lines to be separated into the upper and lower parts, thereby shortening the address time into ¼ in comparison to the prior art. As a result, the sustaining discharge can be uniformly generated on the panel by shortening the address time.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having cells formed at each intersecting position between N row lines and M column lines wherein N and M are integers, comprising:

first and second sustaining electrode lines forming each row line;

first and second address electrode lines for a plurality of cells in each single column line; and insulating material patterns formed in such a manner to be alternately superposed on the first and second address electrode lines as the row lines are progressed, wherein the insulating material patterns prevent generation of a discharge when a data pulse is applied to the first and second address electrode lines at those portions of the first and second electrode lines covered by the insulating patterns.

2. The plasma display panel as claimed in claim 1, wherein an address discharge is simultaneously generated at two row lines by a data pulse applied to the first and second address electrode lines simultaneously and a voltage pulse synchronized with the data pulse to be applied to any one of the first and second sustaining electrode lines.

3. The plasma display panel as claimed in claim 1, wherein the address electrode lines are arranged in such a manner to be divided into the upper and lower parts of the panel.

4. The plasma display panel as claimed in claim 3, wherein an address discharge is simultaneously generated at four row lines by a data pulse applied to the first and second address electrode lines divided into the upper and lower parts simultaneously and a voltage pulse synchronized with the data pulse to be applied to any one of the first and second sustaining electrode lines.

5. The plasma display panel as claimed in claim 1, further comprising:

an upper substrate arranged with the sustaining electrode lines;

a lower substrate arranged with the address electrode lines;

a barrier rib extended in the vertical direction from the lower substrate between the column lines to provide a discharge space within the cell, the discharge space being filled with an inactive gas;

a first dielectric layer formed on the upper substrate arranged with the sustaining electrode lines;

a protective film for protecting the first dielectric layer; and a fluorescent layer coated on the lower substrate arranged with the address electrode lines and the insulating material patterns in such a manner to surround the barrier rib.

6. The plasma display panel as claimed in claim 5, further comprising:

a second dielectric layer formed on the lower substrate arranged with the address electrode lines.

7. A method of driving a plasma display panel having cells formed at each intersecting position between first and second sustaining electrode lines forming a single row line and first and second address electrode lines for a plurality of cells in each single column line, the method comprising:

simultaneously generating an address discharge at two row lines by applying a data pulse to the first and second address electrode lines for a single column of cells simultaneously, wherein an insulating layer is alternatively formed on either of the first and second address electrode lines in each cell so that the address discharge is generated only in the address electrode line on which the insulating layer is not formed; and synchronizing a voltage pulse with the data pulse to be applied to any one of the first and second sustaining electrode lines.

8. The method as claimed in claim 7, wherein the first and second address electrode lines are divided into the row lines to be driven.

9. The method as claimed in claim 7, wherein the address electrode lines are divided into upper and lower parts of the panel to be driven.

10. The method as claimed in claim 9, wherein an address discharge is simultaneously generated at four row lines by a data pulse applied to the first and second address electrode lines divided into the upper and lower parts simultaneously and a voltage pulse synchronized with the data pulse to be applied to any one of the first and second sustaining electrode lines.

11. A plasma display panel having a plurality of discharge cells, comprising:

first and second sustaining electrode lines extending in a first direction;

first and second address electrode lines extending in a second direction and forming a single discharge cell at an intersection of the first and second address electrode lines with the first and second sustaining electrode lines; and insulating material patterns formed in such a manner to be alternately superposed on the first and second address electrode lines as the lines are progressed, wherein the insulating material patterns prevent generation of a discharge when a data pulse is applied to the first and second address electrode lines at those portions of the first and second electrode lines covered by the insulating patterns.

12. A plasma display panel having a plurality of discharge cells, comprising:

first and second sustaining electrode lines extending in a first direction; and first and second address electrode lines extending in a second direction and forming a single discharge cell at an intersection of the first and second address electrode lines with the first and second sustaining electrode lines, wherein the first and second address electrode lines are driven to simultaneously address cells for each of two row lines and wherein an insulating layer is alternatively formed on either of the first and second address electrode lines in each cell so that the address discharge is generated only on the address electrode line on which the insulating layer is not formed.

13. The plasma display panel as claimed in claim 12, wherein the first and second address electrode lines extend in the second direction for a single column of cells.

14. The plasma display panel of claim 11, wherein first and second address electrode lines extend in the second direction for a single column of cells.

15. The plasma display panel of claim 11 further comprising:

a first substrate having a plurality of first and second sustain electrode lines;

a second substrate having a plurality of first and second address lines;

a plurality of barrier ribs formed between the first and second substrates to define a plurality of discharge spaces, each discharge space being filled with gas; and a fluorescent layer coating corresponding surfaces defining each discharge space.

16. The plasma display panel of claim 15, further comprising:

a first dielectric layer formed on the first substrate having the plurality of first and second electrode lines;

a protective film formed on the first dielectric layer; and a second dielectric layer formed on the second substrate having the plurality of first and second electrode lines.

17. The plasma display of claim 12, further comprising:

a first substrate having a plurality of first and second sutstain electrode lines;

a second substrate having a plurality of first and second address lines;

a plurality of barrier ribs formed between the first and second substrates to define a plurality of discharge spaces, each discharge space being filled with gas; and a fluorescent layer coating corresponding surfaces defining each discharge space.

18. The plasma display of claim 17, further comprising:

a first dielectric layer formed on the first substrate having the plurality of first and second electrode lines;

a protective film formed on the first dielectric layer; and a second dielectric layer formed on the second substrate having the plurality of first and second electrode lines.

* * * * *